United States Patent [19]

Pasquale et al.

[11] Patent Number: 5,018,291

[45] Date of Patent: May 28, 1991

[54] DISPLAY HOLDER

[75] Inventors: Frank Pasquale, Towaco; John G. Dewees, Morristown, both of N.J.

[73] Assignee: Trans World Marketing Corporation, East Rutherford, N.J.

[21] Appl. No.: 322,540

[22] Filed: Mar. 13, 1989

[51] Int. Cl.[5] ..... G09F 3/18

[52] U.S. Cl. ..... 40/642; 40/611; 40/152.1

[58] Field of Search ..... 40/642, 661, 649, 152.1, 40/611, 489, 618, 122, 308, 5, 653, 156, 159.2; 220/241, 242

[56] References Cited

U.S. PATENT DOCUMENTS

| | | | |
|---|---|---|---|
| 2,521,558 | 9/1950 | Alvarez | 40/642 |
| 3,150,457 | 9/1964 | Thieme | 40/642 |
| 3,371,439 | 3/1968 | Smith et al. | 40/156 |
| 3,918,187 | 11/1975 | Vogele | 40/152.1 |
| 3,988,846 | 11/1976 | Kuhling | 40/152.1 |
| 4,128,955 | 12/1978 | Marra et al. | 40/642 |
| 4,282,667 | 8/1981 | Glade | 40/649 |
| 4,656,764 | 4/1987 | Fengler | 40/122 |
| 4,805,331 | 2/1989 | Boggess et al. | 40/611 |
| 4,922,639 | 5/1990 | Kehrig | 40/308 |

FOREIGN PATENT DOCUMENTS

| | | | |
|---|---|---|---|
| 1124549 | 10/1956 | France | 40/152 |
| 2440718 | 7/1980 | France | 40/152.1 |
| 1292448 | 10/1972 | United Kingdom | 40/642 |

*Primary Examiner*—Kenneth J. Dorner
*Assistant Examiner*—Brian K. Green
*Attorney, Agent, or Firm*—Ostrolenk, Faber, Gerb & Soffen

[57] ABSTRACT

A holder for displaying a printed sheet on a support wall such as the front face of a vertical machine includes a back plate and a cover plate. The back plate and the cover plate can be assembled together in a snap-fit relationship and the cover plate can be subsequently removed from the back plate. The back plate can be secured to the support wall. The back plate has a front face and a channel formed around the perimeter thereof. The channel rigidifies the back plate and serves to space the back plate from the wall. The cover plate includes a flange which extends around substantially the entire perimeter of the cover plate. The cover plate further includes an inner surface which can be placed adjacent the front face to maintain the printed sheet in a flat position within the display holder.

4 Claims, 3 Drawing Sheets

FIG. 1.
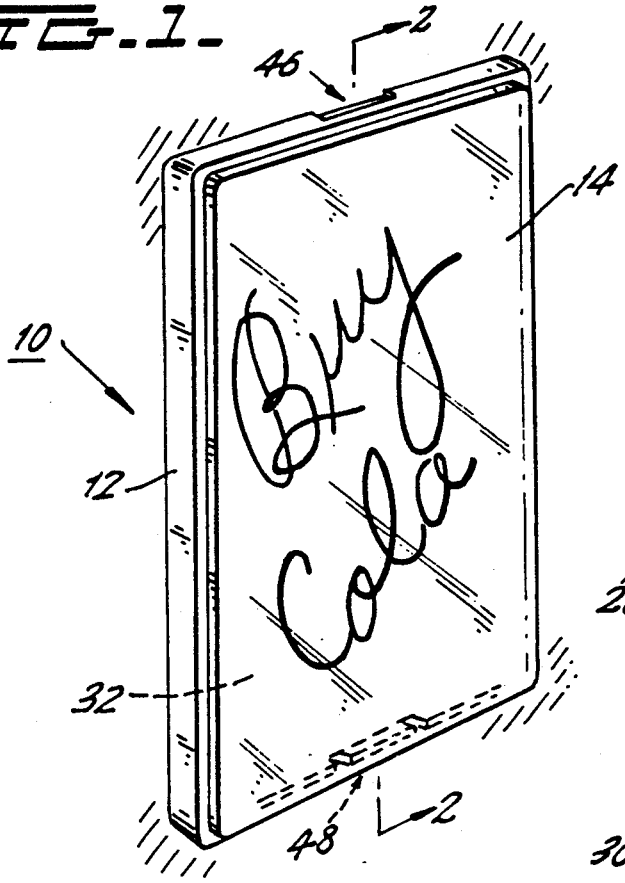
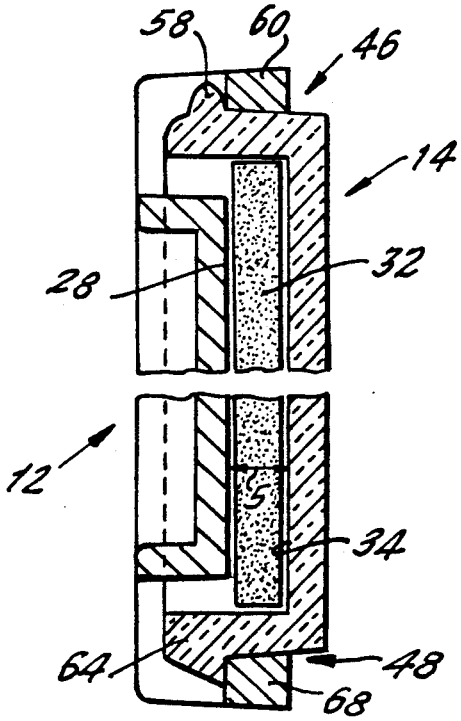
FIG. 3.
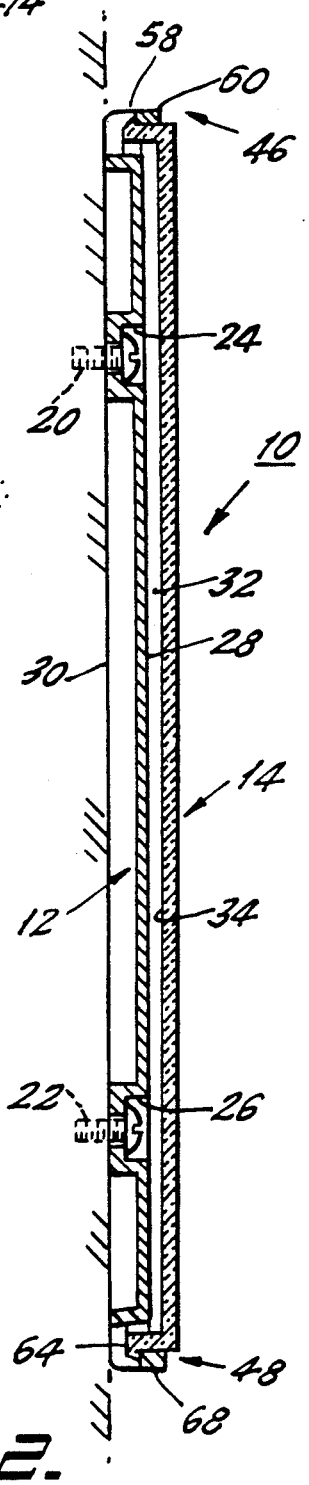
FIG. 2.

DISPLAY HOLDER

BACKGROUND OF THE INVENTION

The present invention relates to an advertising display holder, and more particularly to an advertising display holder which may be coupled to a vending machine or the like Manufacturers of consumer goods are relying more and more heavily on point-of-purchase advertising to advertise and promote their products. They are also relying on promotional campaigns to increase sales In a popular form of promotional campaign the purchaser of a product is given the opportunity to purchase a promotional item (such as a coffee cup or sun visor) bearing the advertiser's trademark at below retail prices if he purchases the manufacturer's product It is desirable to promote such campaigns at the point of purchase.

In order to provide an inexpensive mode to enable the manufacturer to advertise and/or promote his product at the point-of-purchase, it is desirable to provide a display holder which can be coupled to, for example, a vending machine and which can hold advertising and/or promotional material which can be changed on a periodic (for example, monthly) basis.

BRIEF DESCRIPTION OF THE INVENTION

To this end, the present invention provides an advertising display holder which is at the same time inexpensive to manufacture and rugged, and which permits easy replacement of the advertising and/or promotional material on a periodic basis.

In accordance with the foregoing, the present invention is directed towards a display holder comprising:

(A) a back plate having a planar support surface and a channel formed around substantially the entire perimeter of said support surface to rigidify said back plate and to space said support surface from a support wall when said channel is placed against said support wall;

(B) a cover plate comprising a front face and a flange which extends around substantially the entire perimeter of said front face, said flange fitting into said channel and cooperating with said channel to position said support surface and parallel to and spaced from one another; and (C) means for assembling said back plate and said cover plate together in a snap-fit relationship and for permitting said cover plate to be removed from said back plate when desired.

BRIEF DESCRIPTION OF THE DRAWINGS

For the purpose of illustrating the invention, there is shown in the drawings the form which is presently preferred, it being understood, however, that the invention is not limited to the precise arrangements and instrumentality shown.

FIG. 1 is a perspective view of a preferred embodiment of the invention in its assembled condition;

FIG. 2 is a side sectional view taken through lines 2—2 of FIG. 1;

FIG 3 is a discontinuous enlargement of FIG. 2;

DESCRIPTION OF THE PREFERRED EMBODIMENT

Figures 4, 5, 6, 7, 8, 9, 10, 11:
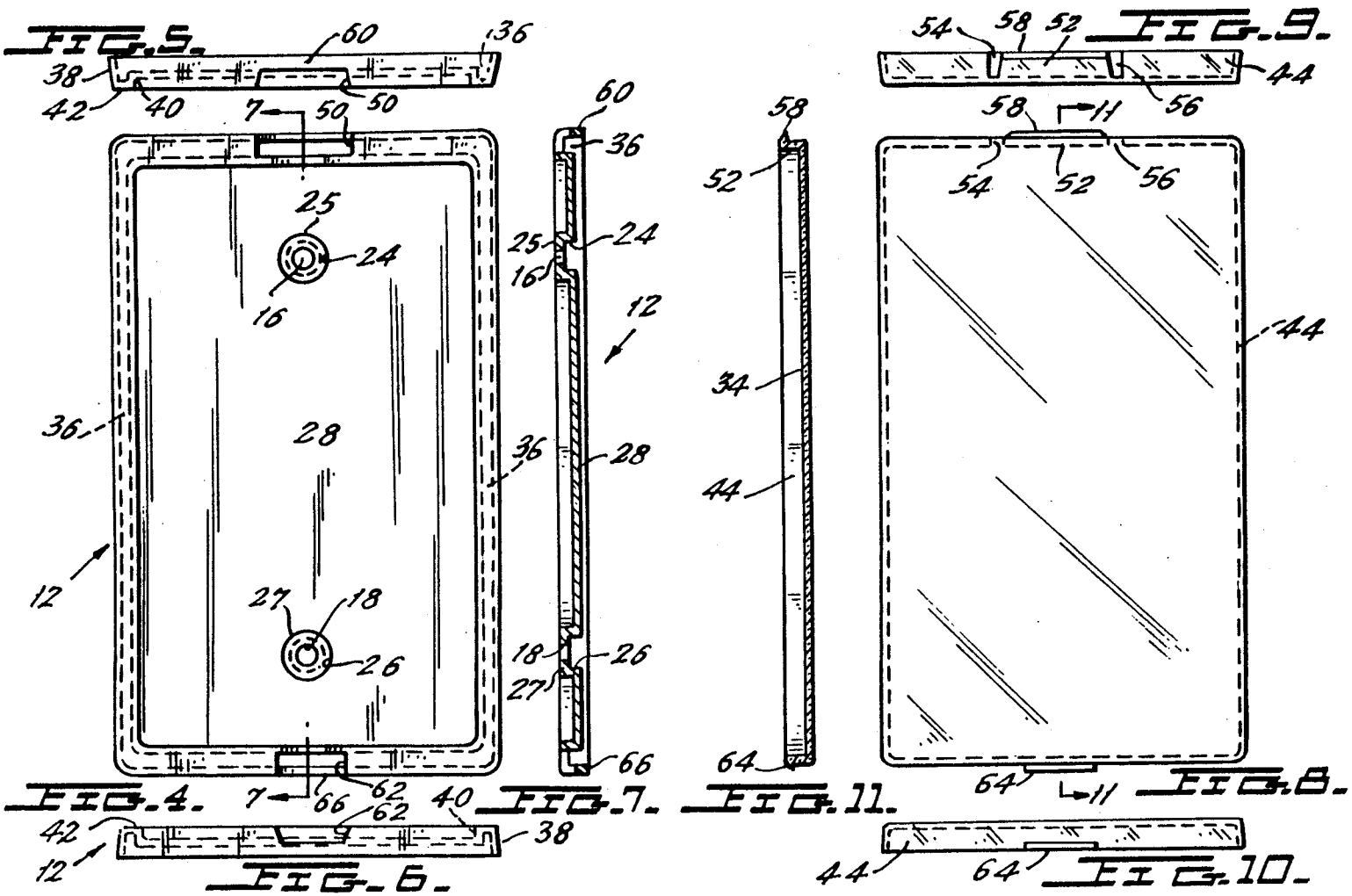
FIG. 4 is a back view of a back plate comprising part of applicant's preferred embodiment.
FIG. 5 is a top view of the back plate of FIG. 4.
FIG. 6 is a bottom view of the back plate of FIG. 4.
FIG. 7 is a cross-sectional view taken along lines 7—7 of FIG. 4.
FIG. 8 is a front view of a cover plate of the preferred embodiment.
FIG. 9 is a top view of the cover plate of FIG. 8.
FIG. 10 is a bottom view of the cover plate of FIG. 8.
FIG. 11 is a side cross-sectional view through lines 1—1 of FIG. 8.

Referring now to the drawings wherein like numerals indicate like elements, there is shown in FIGS. 1–12 an advertising display holder constructed in accordance with the principles of the present invention and designated generally as 10. Display holder 10 includes a transparent plastic back plate 12 and a transparent plastic cover plate 14 removably attached thereto.

The back plate 12 is shown in detail in FIGS. 4–7 and is adapted to be coupled to a support wall, such as the front wall of a vending machine. To this end, the back plate 12 includes an upper screw hole 16 and a lower screw hole 18 for accommodating screws 20 and 22 (FIG. 2), respectively. Each of the holes 16, 18 is surrounded by a respective recess 24, 26 formed in the planar support surface 28 forming the central region of the back plate 12. The recesses 24, 26 accomodate the heads of the screws 20, 22 (or equivalent support coupling means) when the screws 20 and 22 are passed through the back plate 12 to couple the back plate to the support wall 30 (such as the front wall of a vending machine).

The support surface 28 acts as a back support for the advertising media 32 to be displayed. More particulary, the media 32 is placed between the back plate 12 and the cover plate 14 and, as best shown in FIG. 3, is wedged between the support surface 28 and the rear surface 34 of the cover plate 14. This maintains media 32 in a desired flat orientation within display 10.

In addition to accomodating the heads of the support screws 20, 22, the recesses 24, 26, which are strengthened by thickened ridges 25, 27, further serve to space the support surface 28 of the back plate 12 from the support wall 30 (shown in phantom in FIG. 2).

A channel 36 is formed along the entire perimeter of the back plate 12 and is defined by an outer wall 38, an inner wall 40 and a bottom wall 42. The channel 36 serves both the strengthen and rigidify the back plate 12 and to receive a peripheral flange 44 extending around the outer periphery of the face plate 14. The cooperation between flange 44 and the channel 36 insures proper lateral alignment between the back plate 12 and the face plate 14 and also insures the proper spacing S (FIG. 3) between the support surface 28 and the rear surface 34 of the face plate 14 so as to snugly receive the advertising media 32. More particularly, when the face plate 14 is operatively coupled to the back plate 12, the distal end of flange 44 rests against the bottom wall 42 of channel 36 and the rear surface 34 of the face plate 14 is maintained at the proper distance S from the support surface 28 due to the relative depth of the channel 36 and the length of flange 44.

The face plate 14 must be removably connected to the back plate 12 so that the advertising media 32, can be periodically changed. To this end, a pair of latches 46, 48 are integrally formed in the back plate 12 and the cover plate 14. The latches 46, 48 enable the cover plate 14 to be snap-fit onto the back plate 12 and to be removed therefrom whenever it is necessary to replace the advertising media 32. The upper latch 46 is defined by a slot 50 (FIGS. 4 and 5) formed in the bottom wall 42 and outer wall 38 of the channel 36 (which slot forms a transverse flexible beam 60) and a corresponding tongue 52 (FIGS. 8 and 9) formed in the peripheral flange 44 of the cover plate 14. The formation of the slot 50 leaves a transverse beam 60 extending between the remaining portions of outer wall 38 surrounding the slot 50. The transverse beam 60 is preferably flexible and can be moved above the plane of outer wall 38.

In the preferred embodiment, the upper tongue 52 is formed by cutting a pair of slots 54, 56 in the peripheral flange 44. So formed, the tongue 52 will be flexible and may be moved below the plane of flange 44. A rounded boss 58 is formed in the distal end of tongue 52 and cooperates with the transverse beam 60 so that the tongue 52 can be snap-fit into the slot 54 and locked in place by the interaction of boss 58 and beam 60 as best shown in FIG. 2.

While the upper latch 46 is formed of relatively flexible components, the lower latch 48 is preferably formed of relatively rigid components. Like the upper latch 46, the lower latch 48 comprises a slot and boss which interact to hold the back plate 12 and the face plate 14 together To make a more rigid structure, however, the boss 64 of the lower latch 48 is formed directly on the peripheral flange 44 rather than on a flexible tongue formed in the flange 44. To further reduce the flexibility of the latch 48, the slot 62 is narrower than the corresponding slot 50 of the upper latch 46. As a result, the transverse beam 66 will be shorter than the corresponding transverse beam 60 and will be less flexible than the beam 60.

Figure 12:
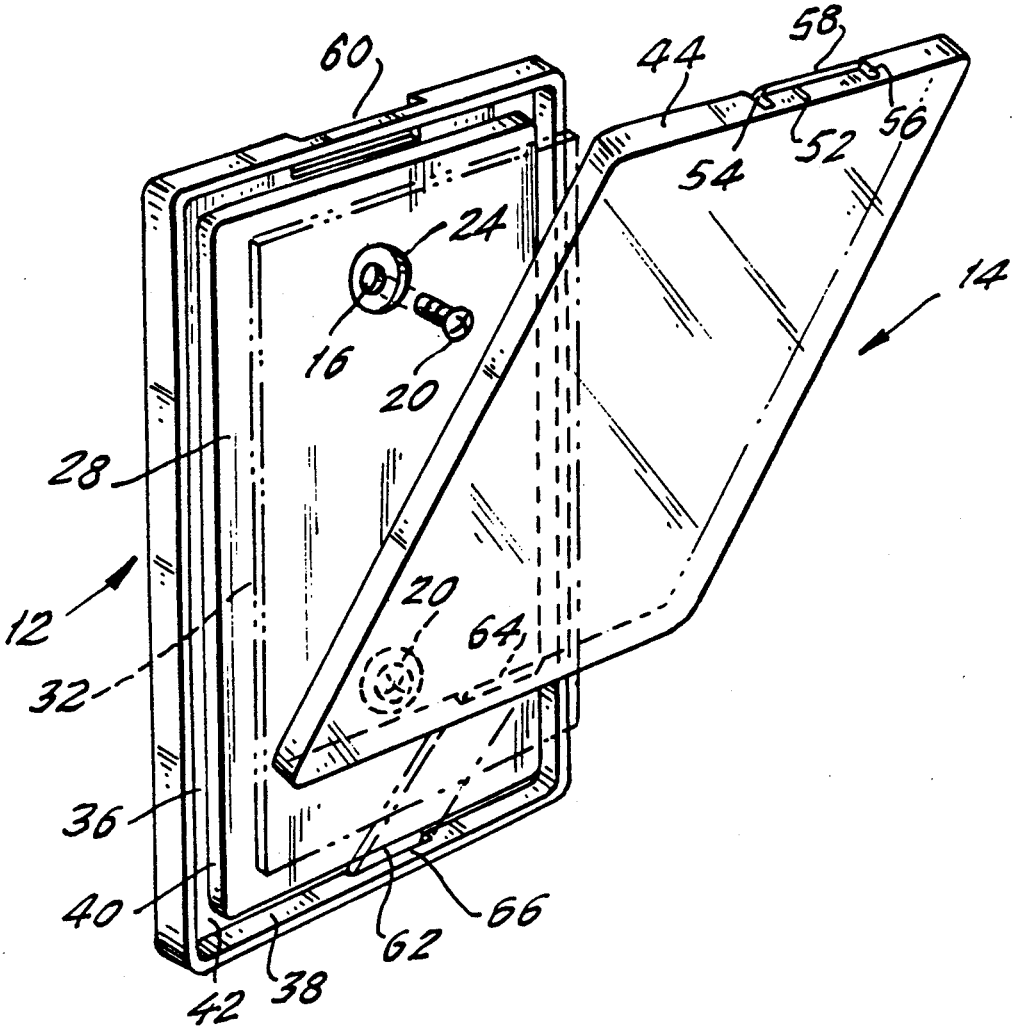
FIG. 12 is an exploded view of the preferred embodiment.

The lower latch 48 is formed of less flexible elements than the upper latch 46 because the cover plate 14 is intended to be attached to the back plate 12 as shown in FIG. 12. More particularly, the lower latch 48 is first engaged by placing the boss 64 in the slot 62 and then rotating the upper portion of the cover plate 14 counterclockwise, as viewed in FIG. 2, until the boss 58 of the upper latch 46 snaps below transverse beam 60 and engages the rear side of the transverse being as best shown in FIG. 3.

Since the boss 64 of the bottom latch 48 is intended to be inserted, rather than snap-fit together, the boss 64 is preferably wedge shaped as best shown in FIG. 3. In contrast, the boss 58 is rounded so that it can smoothly move below the transverse beam 60 when the upper latch is being snapped in place.

To remove the cover plate 14 from the back plate 12 (and thereby enable the advertising media 32 to be replaced), the operator can insert a screwdriver or similar device between the transverse beam 60 and the tongue 52 so as to force the beam 60 upwardly and the boss 58 downwardly. By rotating the screwdriver in a counterclockwise direction as illustrated in FIG. 2, the operator may then cause the cover plate 14 to be withdrawn from the back plate 12 to the position illustrated in FIG. 12. A new advertising media 32 can be placed in the holder and the cover plate snap-fit back onto the back plate 12.

Although the present invention has been described in connection with the preferred embodiment thereof, many variations and modifications will now become apparent to those skilled in the art. It is preferred, therefore, that the present invention be limited not by the specific disclosure herein, but only by the appended claims.

What is claimed is:

1. A holder for displaying a printed sheet on a support wall, comprising:

(A) a back plate having a planar support surface and a channel formed around substantially the entire perimeter of said support surface to rigidify said back plate and to space said support surface from a support wall when said channel is placed against said support wall;

(B) a cover plate comprising a front face and a flange which extends around substantially the entire perimeter of said front face, said flange fitting into said channel and cooperating with said channel to position said support surface and a rear surface of said front face parallel to and spaced from one another; and (C) means for snap fitting said back plate to said cover plate; wherein said snap-fitting means includes:

(1) a first notch formed in said back wall and said outer wall, said notch being located at a first end of said back plate, said notch defining a first, resilient transverse beam in said outer wall;

(2) a first boss formed on a resilient tongue formed in said flange of said cover plate, the relative resiliency of said first transverse beam and said tongue permitting said first boss to be snap-fit past said first transverse beam and inserted and retained behind said resilient transverse beam when said resilient tongue is inserted into said first notch;

(3) a second notch formed in said back wall and said outer wall, said second notch being located at a second end of said back plate which is opposite from said first end, said second notch defining a second transverse beam in said outer wall;

(4) a second boss on said flange of said cover plate, said second boss being insertable into said second notch and, when so inserted, being retained behind said second transverse beam;

wherein said channel has a generally U-shaped cross-section designed to receive said flange; said channel including an inner wall which extends from said support surface in a first direction, a back wall which extends from said inner wall and generally parallel to said support surface, and an outer wall which extends from said back wall in a direction which is generally parallel to and opposite to said first direction.

2. The holder of claim 1, wherein said first notch is wider than said second notch.

3. The holder of claim 1, wherein said first tongue is formed in said flange of said cover plate by a pair of slots which extend across substantially the entire depth of said flange.

4. The holder of claim 1, wherein said first boss has a curved profile and said second boss has a wedge shaped profile.

* * * * *